US006398596B1

(12) United States Patent
Malin

(10) Patent No.: US 6,398,596 B1
(45) Date of Patent: Jun. 4, 2002

(54) GROUND CLAMP

(75) Inventor: Glen K. Malin, New York, NY (US)

(73) Assignee: Allied Bolt, Inc., Hollis, NY (US)

( * ) Notice: Subject to any disclaimer, the term of this patent is extended or adjusted under 35 U.S.C. 154(b) by 0 days.

(21) Appl. No.: 09/216,451

(22) Filed: Dec. 18, 1998

(51) Int. Cl.[7] ..... H01R 4/38

(52) U.S. Cl. ..... 439/800; 439/100; 439/388; 439/785; 174/78

(58) Field of Search ..... 439/100, 799, 439/800, 801, 785, 388, 389; 174/78

(56) References Cited

U.S. PATENT DOCUMENTS

| | | | | | |
|---|---|---|---|---|---|
| 585,185 | A | | 7/1897 | Crane | |
| 846,400 | A | | 3/1907 | Cox | |
| 907,542 | A | | 12/1908 | Vogel | |
| 1,053,684 | A | | 2/1913 | Vogel | |
| 1,552,932 | A | | 9/1925 | Kessler | |
| 1,675,163 | A | | 6/1928 | Colburn | |
| 1,748,536 | A | * | 2/1930 | Borden | 439/100 |
| 1,809,009 | A | | 6/1931 | Andre | |
| 3,564,116 | A | * | 2/1971 | Joseph et al. | 174/88 |
| 3,609,631 | A | | 9/1971 | Looney et al. | |
| 4,591,229 | A | | 5/1986 | Sachs | |
| 4,626,051 | A | | 12/1986 | Franks, Jr. | 339/14 R |
| 4,664,469 | A | * | 5/1987 | Sachs | 439/100 |
| 4,780,096 | A | | 10/1988 | Franks, Jr. | |
| 5,131,856 | A | | 7/1992 | Auclair | |
| 5,314,343 | A | | 5/1994 | Englander | |
| 5,616,036 | A | * | 4/1997 | Polidori | 439/100 |

FOREIGN PATENT DOCUMENTS

| | | |
|---|---|---|
| FR | 543501 | 11/1921 |
| FR | 543501 | 5/1922 |

* cited by examiner

*Primary Examiner*—Tho D. Ta
*Assistant Examiner*—Truc T. T. Nguyen
(74) *Attorney, Agent, or Firm*—Wolf, Greenfield & Sacks, P.C.

(57) ABSTRACT

A universal ground clamp for connecting a ground wire to a grounding electrode of various diameters having a thin insulating layer without damaging the grounding electrode. The universal ground clamp having an elongated strap that wraps and is secured around the grounding electrode. A first end of the strap has an abrasive outer surface. A fastener frictionally engages against the first end in a direction normal to the grounding electrode, causing the abrasive outer surface to intimately contact the grounding electrode. In a preferred embodiment, the universal ground clamp further comprises a U-shaped bracket which has a first leg having an opening registered with a threaded opening of a second leg. A second end of the strap has a plurality of longitudinally spaced apertures, one of which is aligned between the openings of the first and second legs. A bolt is threadably couplable with the threaded opening and passable through an aperture of the second end of the strap and the opening of the first leg. An electrical coupling device connects the ground wire to the universal ground clamp. The bolt is oriented perpendicular to the first end to permit the bolt to frictionally engage the the first end normal to the grounding electrode and thereby force the outer abrasive surface of the first end of the strap to intimately contact the grounding electrode.

22 Claims, 2 Drawing Sheets

GROUND CLAMP

BACKGROUND OF THE INVENTION

This invention relates in general to electrical grounding clamps, and in particular, to a grounding clamp for use with a grounding electrode such as a pipe, conduit or ground rod.

A number of universal ground clamp devices exist for electrical ground connection with grounding electrodes of various diameters. Conventional devices provide a means to electrically connect solid copper wire such as AWG wires sizes 6–12 to a grounding electrode by a clamp device. However, the coupling of the clamp device must be maintained free from corrosion and mechanical failure at all times, both at the connection with the terminated ground wire and at the connection to the grounding electrode.

When a grounding electrode is covered with paint, rust or some such thin layer of insulating material over the base metal, procedures must be utilized for cleaning the grounding electrode's surface to ensure a suitable grounding. While these surface preparation procedures are usually effective in assuring a properly conditioned surface for grounding, they are also time consuming and, on occasions, may be improperly utilized or not used at all.

In some ground clamps, the ground connection between the ground wire and conduit is achieved by tightening a strap around the grounding electrode. Some of such straps incorporate abrasives that penetrate any oxide layer or paint. Clamps have also been configured in which the bolt that tightens the strap bears normally directly against the grounding electrode. Although, in this arrangement, the bolt can be configured to penetrate any oxide layer or paint, the arrangement has the drawback that the bolt can undesirably penetrate or deform the grounding electrode. As a remedy, in some clamps, a plate, strap, or flap, is disposed between the bolt and grounding electrode such that the bolt bears against the plate, strap, or flap, which presses radially against the grounding electrode. However, with the disposition of the plate, strap, or flap, between the bolt and grounding electrode, good connection between the clamp and a grounding electrode having an oxide layer, paint, plating, or other thin insulating layer cannot be assured.

The present invention provides a structure which is effective to ensure a proper contact with the base metal of the grounding electrode to be grounded, even if the surface has not been properly scraped or sanded, without damaging the grounding electrode.

SUMMARY OF THE INVENTION

Briefly stated, the invention in a preferred form is a universal ground clamp for clamping a ground wire to a grounding electrode comprising an elongated flexible strap sized and shaped to be tightly wrapped and secured around the electrode with the strap having integrally formed thereon projections shaped and sized to cut into the electrode to form an intimate electrical contact, and means for tightening and securing the straps with the projections intimately engaging the surface of the electrode, wherein pressure is exerted on the portion of the strap bearing the projections in a direction normal to the electrode. In one embodiment, the means for securing the strap comprises a U-shaped bracket with a pair of legs between which ends of the strap may extend, and means projecting through the legs and strap for simultaneously securing the U-shaped bracket to the ends of the strap and to the electrode such that the projections are forced into intimate electrical contact with the electrode by normally directed pressure. The projecting means may have a wire engaging means for electrically connecting a wire to the electrode.

The invention is suitable for use with grounding electrodes of various diameters that have an oxide layer, paint, plating or other thin insulating layer. A good electrical connection is formed between the universal ground clamp and the grounding electrode without the risk of puncture or deformation damage to the grounding electrode. In one embodiment, the invention also has the installation advantages of not requiring the removal of any fasteners and only requiring access from one side. In addition, good electrical coupling is assured between the ground wire or wires and the universal ground clamp.

In a preferred embodiment, the universal ground clamp comprises an elongated strap having first and second ends. The first end of the strap has an an abrasive outer surface. The universal ground clamp further comprises a U-shaped bracket which has a first leg which has an opening that is registered with a threaded opening of a second leg. The second end of the strap has a plurality of longitudinally spaced apertures. The second end of the strap is tightly wrapped around the grounding electrode and an aperture is aligned between the opening of the first leg and the threaded opening of the second leg. The first leg may have a retaining flange projecting toward the second leg which acts as a strap guide. A bolt defining a longitudinal axis comprises a torque receiving portion and an axially extending threaded shaft threadably couplable with the threaded opening of the second leg and passable through an aperture of the second end of the strap and the opening of the first leg. An electrical coupling means connects the ground wire to the universal ground clamp. The longitudinal axis of the bolt is oriented perpendicular to the first end to permit the bolt upon application of a torque to the torque receiving portion to frictionally engage the first end substantially perpendicular thereto and thereby force the outer abrasive surface of the first end of the strap to intimately contact the grounding electrode.

In one aspect of the invention, the bolt further comprises an internally threaded head having a transverse opening. A set screw is mountable to the bolt and axially threadably displacable relative to the transverse opening. A terminated ground wire is passable through the transverse opening. Application of a torque to the set screw displaces the set screw relative to the opening, forming an electrical coupling between the universal ground clamp and the ground wire.

In another aspect of the invention, the first end of the strap is connected to the first leg of the U-shaped bracket by welding, riveting or other bonding means.

In a further aspect of the invention the first end of the strap further comprises a loop produced by folding the first end of the strap. The first end wraps around the first leg and further includes a through hole aligned between the openings of the first and second legs. The loop, set adjacent to the first leg of the bracket, the flange, and the wrapped strap maintain the relative positions of the first end and the first leg.

In yet another aspect of the invention, the second end of the strap further comprises an abrasive surface positioned to contact a substantial arcuate portion of the grounding electrode. The abrasive surfaces of the first and second ends of the strap preferably comprise a plurality of cutting edge forming holes formed through the strap.

BRIEF DESCRIPTION OF THE DRAWINGS

The invention is illustrated by way of example in the accompanying drawings, in which.

DETAILED DESCRIPTION

Figure 1:
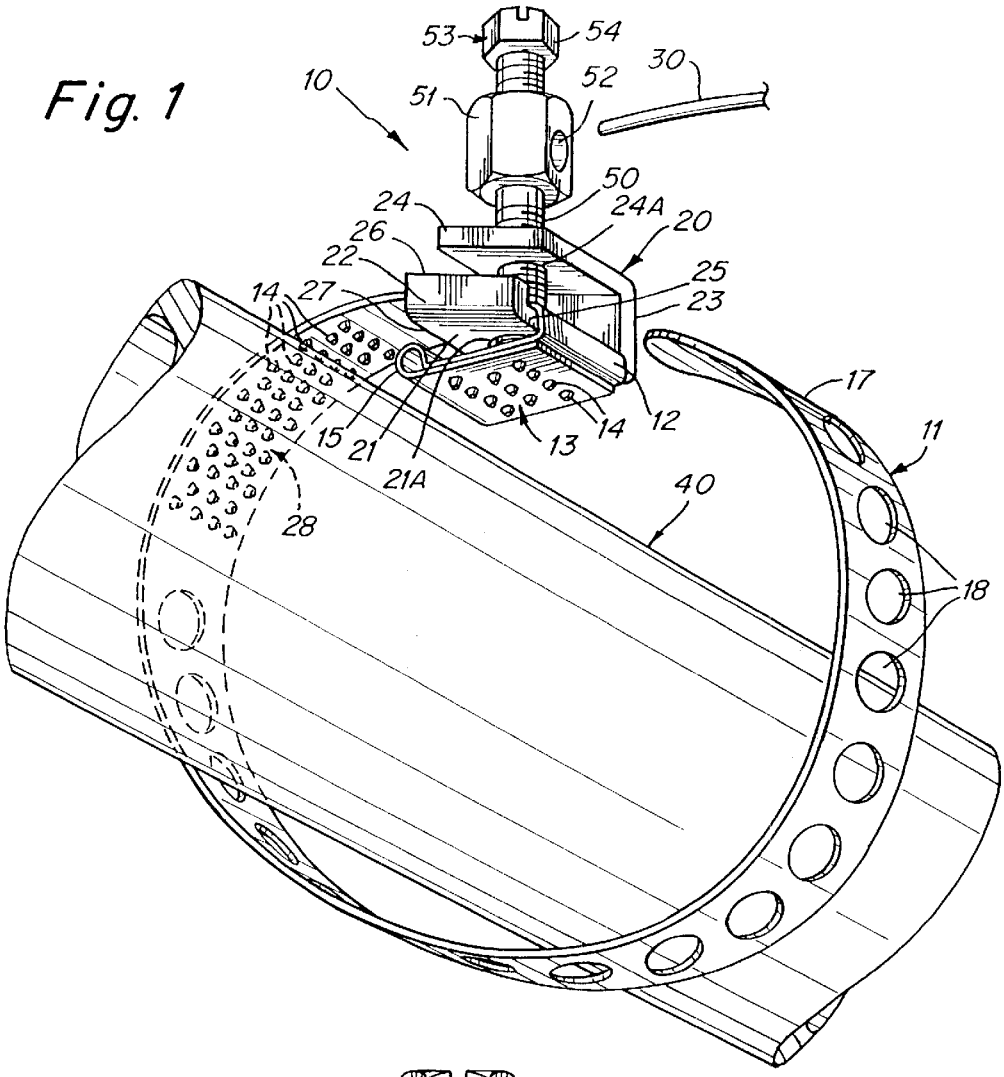
FIG. 1 is a perspective view of a universal ground clamp according to the invention as positioned about a grounding member in a partially installed position.
Figure 2:
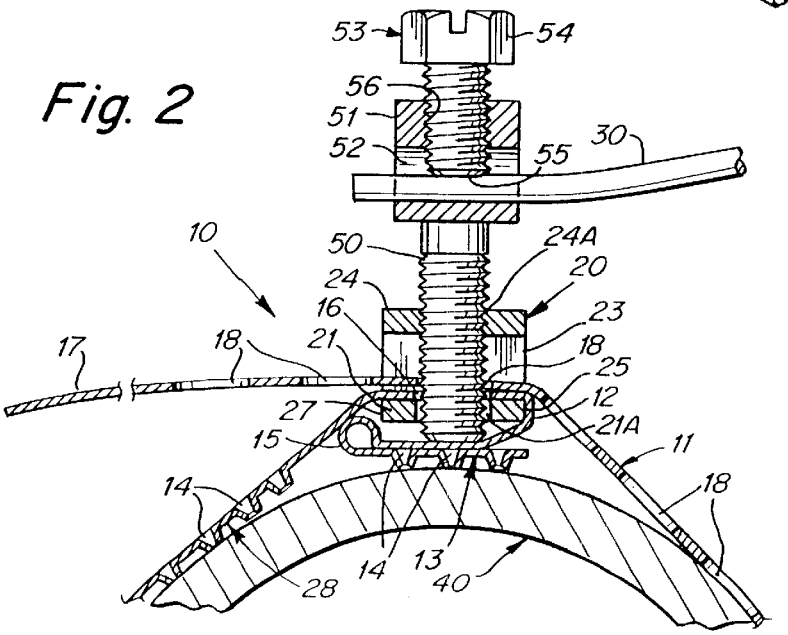
FIG. 2 is a cross-section view showing the universal ground clamp in its installed position.
Figure 3:
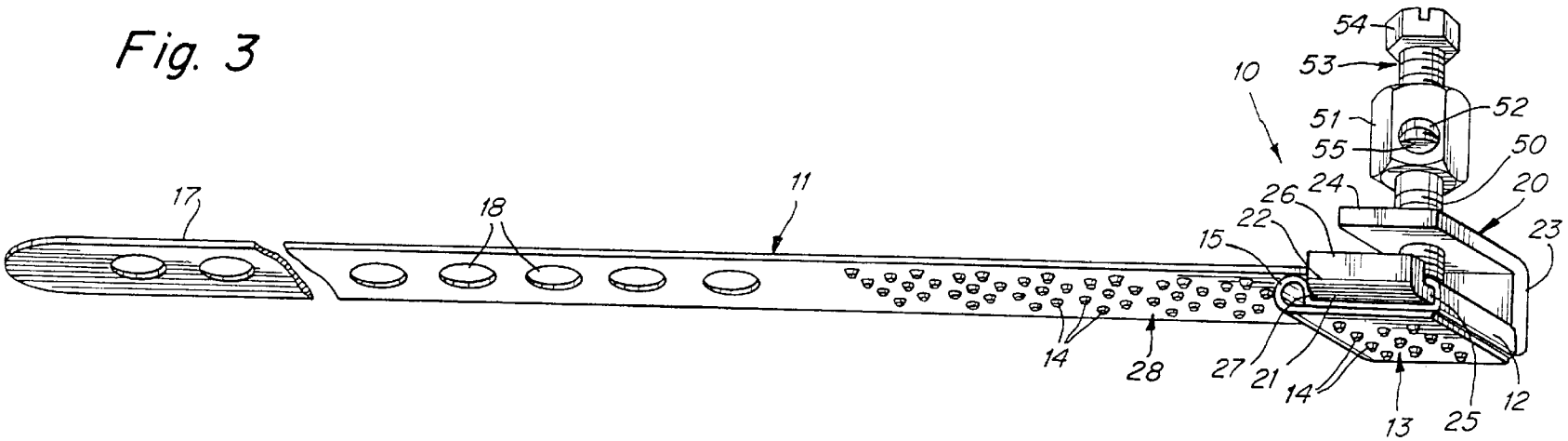
FIG. 3 is a perspective view showing the universal ground clamp in its flat uninstalled position.

Like numerals in the drawings represent like parts throughout the several figures. A universal ground clamp 10 in its preferred application and environment, encircles and electrically engages a grounding electrode 40, such as a water pipe, a service conduit, a rod or a similar grounding member. The universal ground clamp 10 is connected to the terminal end of a ground wire or wires 30 for effecting a ground connection.

The universal ground clamp 10 comprises a strap subassembly and a bolt subassembly. The strap subassembly comprises an elongated ribbon-like thin flexible strap 11, preferably formed of a metal with good electrical conductivity properties such as copper or aluminum. A first end 12 of the strap is engaged with a U-shaped bracket 20. The first end 12 of the strap 11 has an abrasive outer surface 13. In a preferred embodiment, a plurality of holes 14 are punched through the first end 12 with sharp edges to form a grate like surface on one side of the strap 11. Other means of providing an abrasive or friction engaging surface are envisioned. This abrasive or friction engaging surface may comprise other shaped projections or even a laminate of a frictional material. A second end 17 of the strap 11 has a plurality of longitudinally spaced apertures 18 which are sized to permit one end of the bolt described hereafter to pass through.

The U-shaped bracket 20 includes a first leg 21 having an outer end 22 and a second leg 24 with an interconnecting bight 23. Leg 24 is formed with a threaded opening 24A, sized to receive the bolt hereafter described. The opening 24A is registered with an opening 21A in leg 21. The first leg is terminated in a retaining flange 26 projecting from the outer end 22 of the first leg 21 toward the second leg 24. Thus flange 26 functions as a strap guide for strap 11.

In the preferred embodiment illustrated, the first end 12 projects between the legs 21 and 24 with a portion of the holes 14 extending beyond a leading edge 25 of the first leg 21 of the bracket 20. The abrasive or friction engaging surface faces toward leg 21. The portion of the first end 12 extending through the bracket 20 is folded around the leading edge 25 of the first leg 21, covering the bottom surface completely. The first end is folded a second time so that the friction engaging surface at the extreme end of the strap faces away from the bottom of leg 21 in the same direction as the friction engaging surface on the other side of bracket 20. To assist in securing the strap in this position the second fold formed in the strap is enlarged into a loop shape 15 and is positioned to interengage a trailing edge 27 of leg 21.

The first end 12 of the strap has a through hole 16 that registers with the openings 21A and 24A in the first leg and second legs respectively when the strap is in its wrapped position. The flange 26 also serves to maintain the relative positions between the first leg 21 and first end 12 of the strap 11. Alternatively, the first end 12 of the strap can be welded, riveted, or otherwise secured to the first leg 21. In such an embodiment, the strap would not necessarily be wrapped about the first end 12.

The bolt subassembly comprises a shaft 50 and a hex head 51. The shaft 50 is threadably engaged with the threaded opening 24A of the second leg 24. In a preferred embodiment, the hex head 51 includes an aperture 52 which extends transversely through the head 51 for receiving the ground wire or wires 30. The aperture 52 is preferably dimensioned to receive ground wires having a diameter range of AWG sizes 6–12. The hex head 51 also has axial internal threads 56. A set screw 53, also having a hex head 54, axially threads into the hex head 51 to the aperture 52. A distal end 55 of the set screw 53 may be threaded into the aperture 52 of the hex head 51 to engage the ground wire or wires 30 and secure them in fixed grounded relation with the clamp 10. Other typical means of securing a ground wire or wires to a bolt subassembly are also envisioned.

In a preferred installation, the strap 11 is tightly wrapped around the grounding electrode 40 and an aperture 18 of the second end 17 of the strap 11 is brought into alignment with the opening 21A of the first leg 21, the through hole 16 of the strap 11, and the threaded opening 24A of the second leg 24 to thereby form a strap loop. The flange 26 also functions to guide the second end 17 of the strap 11.

The shaft 50 is threaded into the opening 24A passing through the aligned strap aperture 18, the through hole 16 of the first end 12 and the opening 21A of the first leg 21. A torque applied to the hex head 51 threadably displaces the shaft axially to bear against the first end 12 of the strap 11, thereby pressing the abrasive outer surface 13 into surface-to-surface engagement against the grounding electrode 40 and clamping the strap 11 in position around the grounding electrode 12 to make a good electrical grounding connection.

In a preferred embodiment, the second end 17 of the strap 11 has an abrasive surface 28, formed by a plurality of holes 14, to engage the outer surface of the grounding electrode 40 upon tightening of the strap, to cut or scrape through the outer surface thereof to further ensure a proper electrical contact.

It should be appreciated that the foregoing universal ground clamp provides an efficient means for clamping against a grounding electrode with an oxidizing layer, paint or plating, without puncturing or deforming the electrode. Furthermore installation is achieved without the removal of any fasteners. Finally, the torque required to mount and secure the clamp in position as well as to secure the ground wires is applied from one side of the strap and thus the universal ground claim is particularly advantageous in applications where the room constraints do not easily permit application of a torque from both sides of the strap.

While the present invention contemplates in its preferred embodiment the arrangements illustrated in the drawings, the applicant also contemplates securing the strap by other means provided the strap is reliable and permanently secured, such as by use of a tourniquet. Also contemplated are variations in nonpreferred embodiments of the abrasive or frictional engaging surface on the strap such as a laminate of a conductive frictional or abrasive material or alternate surface treatment of one surface of the strap that does not require forming through holes. In addition other means may be used to secure the ground wire to the universal ground clamp.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A universal ground clamp for connecting a ground wire to a grounding electrode comprising, a grounding electrode, an elongated flexible strap sized and shaped to be tightly wrapped and secured around the grounding electrode with the strap having integrally formed thereon projections shaped and sized to cut into the electrode to form an intimate electrical contact and with the ends of the strap overlapping and lying substantially parallel to the grounding electrode, and means for securing the strap comprising a U-shaped bracket with a pair of legs between which the ends of the strap extend, and means projecting through said legs and strap for simultaneously securing said U-shaped bracket to the ends of said strap and to said electrode such that the projections are forced into intimate electrical contact with the electrode by normally directed pressure, said projecting means having wire engaging means for electrically connecting said wire to said electrode.

2. A universal ground clamp for connecting a ground wire to a grounding electrode comprising:

an elongated strap being wrappable around the grounding electrode, and having first and second overlapping ends; the first end having an abrasive outer surface and being proximate to the grounding electrode, and the second end being distal to the grounding electrode;

a fastener engageable with overlapping portions of the strap and with the first end of the strap bearing the abrasive surface facing a surface of the electrode, and means for securing the strap by a force applied to the first end of the strap toward the electrode;

wherein the fastener comprises a U-shaped bracket having a first leg, a second leg and a bight therebetween, the first leg including an opening registered with a threaded opening of the second leg.

3. The universal ground clamp of claim 2, wherein the first leg has a retaining flange projecting toward the second leg to guide the strap.

4. The universal ground clamp of claim 2, wherein the second end of the strap has a plurality of longitudinally spaced apertures, an aperture being alignable between the opening of the first and second legs.

5. The universal ground clamp of claim 2, wherein an electrical coupling connects the ground wire to the universal ground clamp.

6. The universal ground clamp of claim 2, wherein the first end of the strap is connected to the first leg of the U-shaped bracket.

7. The universal ground clamp of claim 3, wherein the first end of the strap projects between the first and second legs, wraps around a leading edge of the first leg and includes a hole registered between the opening of the first and second legs; the first end of the strap further comprising a loop produced by folding the first end of the strap, wherein the loop, set adjacent to a trailing edge of the first leg of the bracket, the flange, and the wrapped strap maintain the relative positions of the first end and the first leg.

8. The universal ground clamp of claim 4, wherein the fastener further comprises a bolt defining a longitudinal axis having a torque receiving portion and an axially extending threaded shaft threadably couplable with a threaded opening of the second leg and passable through an aperture of the second end of the strap and the opening of the first leg, wherein the longitudinal axis of the bolt is oriented perpendicular to the first end to permit the bolt upon application of a torque to the torque receiving portion to frictionally engage the first end substantially perpendicular thereto and thereby force the outer abrasive surface of the first end of the strap to intimately contact the surface of the grounding electrode.

9. The universal ground clamp of claim 8, wherein the bolt further comprises a transverse opening and an internally threaded head; a set screw mountable to the bolt and axially threadably displacable relative to the opening; wherein a terminated ground wire is passable through the transverse opening, whereby application of a torque to the set screw displaces the set screw relative to the opening, forming an electrical coupling between the universal ground clamp and the ground wire.

10. The universal ground clamp of claim 9, wherein the head of the bolt is a hex head and the set screw further comprises a hex head.

11. A universal ground clamp for connecting a ground wire to a grounding electrode comprising:

a grounding electrode, an elongated flexible strap having a first end and a second end and an inner surface and an outer surface, the strap shaped and sized to be tightly wrapped and secured around the grounding electrode with the inner surface of the second end of the strap overlapping the outer surface of the first end of the strap, and the ends of the strap lying substantially concentric with a surface of the grounding electrode;

projections, integrally formed on the strap, shaped and sized to cut into the grounding electrode to form an intimate electrical contact; and means for securing the strap with the projections intimately engaging the surface of the grounding electrode, wherein pressure is exerted on the first end of the strap in a direction toward the surface of the grounding electrode;

wherein the means for securing the strap comprises a U-shaped bracket with a pair of legs between which the ends of the strap extend, and means projecting through said legs and strap for simultaneously securing said U-shaped bracket to the ends of said strap and to said grounding electrode such that the projections are forced into intimate electrical contact with the grounding electrode by pressure directed normal to the surface of the strap, said projecting means having wire engaging means for electrically connecting said wire to said electrode.

12. The universal ground clamp of claim 11, wherein the pressure is directed towards the surface of the grounding electrode.

13. A universal ground clamp for connecting a ground wire to a grounding electrode comprising:

an elongated strap being wrappable around the grounding electrode, and having first and second overlapping ends; the first end having an abrasive outer surface and being proximate to the grounding electrode, and the second end being distal to the grounding electrode;

a fastener engageable with overlapping portions of the strap and with the first end of the strap bearing the abrasive surface facing a surface of the electrode, and means for securing the strap by a force applied to the first end of the strap toward the electrode;

wherein the abrasive surface of the first end is placed in contact with the surface of the grounding electrode directly beneath the fastener.

14. The universal ground clamp of claim 13, wherein the fastener comprises a U-shaped bracket with a pair of legs between which the ends of the strap extend, and the means for securing comprises means projecting through said legs and strap for simultaneously securing said U-shaped bracket to the ends of said strap and to said grounding electrode such that the abrasive surface is forced into intimate electrical contact with the grounding electrode by pressure directed normal to the surface of the strap, said abrasive surface having wire engaging means for electrically connecting said wire to said electrode.

15. The universal ground clamp of claim 13, wherein the fastener comprises a U-shaped bracket having a first leg, a second leg and a bight therebetween, the first leg including an opening registered with a threaded opening of the second leg.

16. The universal ground clamp of claim 13, wherein an electrical coupling connects the ground wire to the universal ground clamp.

17. The universal ground clamp of claim 15, wherein the first end of the strap is connected to the first leg of the U-shaped bracket.

18. The universal ground clamp of claim 15, wherein the first leg has a retaining flange projecting toward the second leg to guide the strap.

19. The universal ground clamp of claim 18, wherein the first end of the strap projects between the first and second legs, wraps around a leading edge of the first leg and includes a hole registered between the opening of the first and second legs; the first end of the strap further comprising a loop produced by folding the first end of the strap, wherein the loop, set adjacent to a trailing edge of the first leg of the bracket, the flange, and the wrapped strap maintain the relative positions of the first end and the first leg.

20. The universal ground clamp of claim 18, wherein the second end of the strap has a plurality of longitudinally spaced apertures, an aperture being alignable between the opening of the first and second legs.

21. The universal ground clamp of claim 20, wherein the fastener further comprises a bolt defining a longitudinal axis having a torque receiving portion and an axially extending threaded shaft threadably couplable with a threaded opening of the second leg and passable through an aperture of the second end of the strap and the opening of the first leg, wherein the longitudinal axis of the bolt is oriented perpendicular to the first end to permit the bolt upon application of a torque to the torque receiving portion to frictionally engage the first end substantially perpendicular thereto and thereby force the outer abrasive surface of the first end of the strap to intimately contact the surface of the grounding electrode.

22. The universal ground clamp of claim 21, wherein the bolt further comprises a transverse opening and an internally threaded head;

a set screw mountable to the bolt and axially threadably displacable relative to the opening;

wherein a terminated ground wire is passable through the transverse opening, whereby application of a torque to the set screw displaces the set screw relative to the opening, forming an electrical coupling between the universal ground clamp and the ground wire.

* * * * *